United States Patent [19]

Kishimoto et al.

[11] Patent Number: 4,466,604

[45] Date of Patent: Aug. 21, 1984

[54] ELEVATOR TYPE PAPER FEEDING APPARATUS

[75] Inventors: Tadao Kishimoto, Hachioji; Takao Tsuda, Hino, both of Japan

[73] Assignee: Konishiroku Photo Industry Co., Ltd., Tokyo, Japan

[21] Appl. No.: 305,391

[22] Filed: Sep. 25, 1981

[30] Foreign Application Priority Data

Oct. 24, 1980 [JP] Japan ..... 55-152899[U]

[51] Int. Cl.³ ..... B65H 7/08

[52] U.S. Cl. ..... 271/111; 271/155; 271/157

[58] Field of Search ..... 271/110, 111, 154, 155, 271/157

[56] References Cited

U.S. PATENT DOCUMENTS 3,378,254 4/1968 Eichorn ..... 271/155

3,768,806 10/1973 Reehil ..... 271/155

*Primary Examiner*—Richard A. Schacher

*Attorney, Agent, or Firm*—Jordan B. Bierman; Linda Bierman; C. Cornell Remsen, Jr.

[57] ABSTRACT

The apparatus includes a vertically movable paper tray that descends to its lowered condition when a copier door is opened for resupply of copy sheets, a switch for detecting the fully raised sheet feeding condition of the tray, and a photosensor for detecting the presence of paper on the tray as the tray is raised toward its fully raised condition. A copier operation enabling signal is generated in response to the position of the door and the photosensor output, with a suitable time delay to prevent copying until the tray has attained its fully raised condition following detection of the presence of paper by the photosensor.

2 Claims, 4 Drawing Figures

ELEVATOR TYPE PAPER FEEDING APPARATUS

BACKGROUND OF THE INVENTION

1. Field of the Invention

The present invention relates to a paper feeding tray for a copying machine, printing machine or the like, and more particularly to an electric circuit thereof for generating GO and NO GO signals for the drawing of recording sheets from the tray.

2. Description of the Prior Art

A known elevator type paper feeding tray in a copying machine or printing machine or the like is constructed as shown in FIG. 1. Disposed within a tray frame 1 is a movable elevating plate 2 that ascends and descends in parallel with tray frame 1. Plate 2 descends to its lowermost position and stops there when a door (not shown) attached to tray frame 1 is opened as, for example, to enable restocking of plate 2 with sheets of transfer paper.

Located in the upper interior of tray frame 1 are a paper feeding roller 3 for feeding transfer sheets P, the shaft of which roller is disposed for vertical movability over a fixed range, a position detecting switch 4 for detecting the uppermost position of a pile or stack of transfer sheets P, and a photosensor 5 for sensing whether or not the tray contains transfer sheets P.

Switch 4 is a microswitch that performs position detection through contact between its actuator and the uppermost transfer sheet P.

Photosensor 5 is a detection element combinationally comprising a light emitting diode and a light receptive diode; the presence or absence of transfer paper on plate 2 is detected by reflection of light from the upper surface of transfer paper P. Thus, if there is no transfer paper P in position (in accordance with the operation of switch 4) and the light receptive diode detects light reflected from the surface of elevating plate 2, or if transfer paper P is fairly distant from photosensor 5, the resulting determination is that no transfer paper P is present in the tray.

Now, when the door is closed after transfer sheets or paper P has been placed on plate 2, the plate is elevated by a lifting mechanism (not shown) to its normal position in which the topmost sheet of transfer paper P comes into pressure contact with paper feeding roller 3—at which point elevation of plate 2 is discontinued.

When copying operations subsequently commence, the upper surface level of the stack of transfer paper P on plate 2 gradually descends as the transfer sheets are fed one after another by operation of paper feeding roller 3.

As the upper surface level of the transfer sheet stack drops below a prescribed level, microswitch 4 detects such lowered level (through a change in its operating state) and plate 2 is again elevated by the lifting mechanism until the upper surface of the transfer sheet stack has resumed its normal level. During this period, the feeding of transfer papers P continues by operation of paper feeding roller 3.

These operations are performed repeatedly. When the door is opened, however, paper feeding is halted and elevating plate 2 descends to and stops at the bottom of the tray.

The aforedescribed elevator type paper feeding tray is capable of being loaded with a large quantity of transfer paper—in some cases several thousands of sheets—and of continuous sheet feeding, making it a very convenient apparatus for use in a high speed copying machine.

However, in copying machines or the like having an elevator type paper feeding tray, the normally smooth paper feeding operations are disturbed when, after the door has been opened for one reason or another, further copying is attempted immediately following closing of the door. Put another way, paper feeding problems and smooth copying operations are likely to be interrupted when further copying is attempted before or within the period of time necessary to elevate the transfer sheet stack to its normal or prescribed level after the door is closed, or when copying is attempted despite the lack of transfer paper in the tray.

SUMMARY OF THE INVENTION

The present invention relates to an elevator type paper feeding tray having a control circuit for generating GO and NO GO signals as to whether the situation is suitable for copying. Moreover, the invention accomplishes this objective by means of a simple circuit generating such signals in response to inputs from a photosensor and an element indicating the open and closed states of the door.

An elevator type paper feeding tray in accordance with the invention includes a detection circuit wherein a GO signal for copying is output a prescribed period of time T1 after appropriate input signals have been received indicating both the presence of transfer sheets in the tray and that a door of the apparatus is closed, wherein a NO GO signal for copying is output a prescribed period of time T2 after at least one of the said two input signals indicate its detected state to be otherwise, and wherein the relationship between T1 and T2 is $0 \leqq T2 < T1$.

DETAILED DESCRIPTION OF THE PREFERRED EMBODIMENT

The present invention is now explained with reference to the drawings.

Figure 1A:
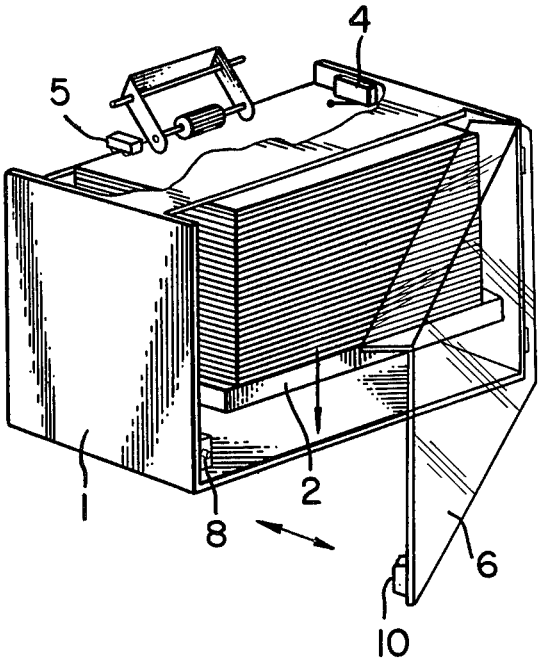
FIG. 1A is a similar perspective view of an elevator type paper feeding tray according to the present invention.

In FIG. 1A there have been added to the prior art paper feeding tray a door 6, a door closure detector 8, which may be a conventional push-button switch, and an actuator 10 for the latter.

Figure 1:
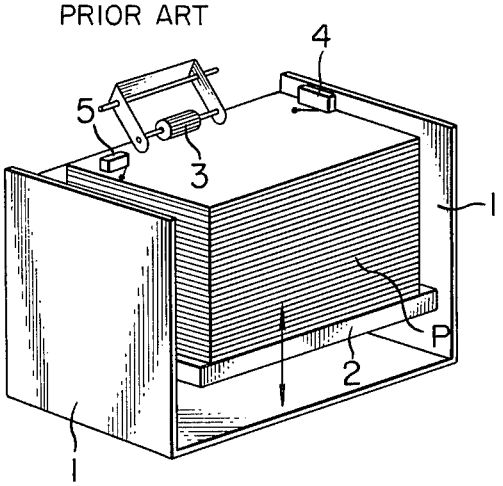
FIG. 1 PRIOR ART
FIG. 1 is an elevated perspective view of a known elevator type paper feeding tray.
Figure 2:
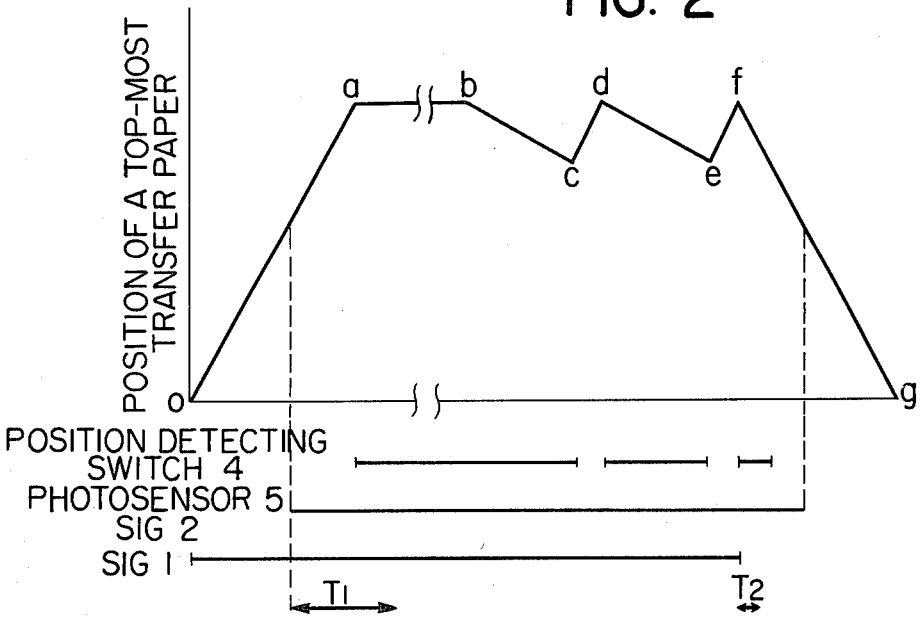
FIG. 2 is a graph expressing the relation between the position of the uppermost sheet on the stack of transfer paper and the operations of sensors, switches, etc.

FIG. 2 illustrates the relationship between the upper surface—or topmost sheet—of the transfer paper stack and the operating states of position detecting switch 4, photosensor 5 and door switch output signal SIG-1. In the disclosed embodiment, when the door 6 is closed and/or detector 8 is actuated after transfer papers P have been placed on elevating plate 2, SIG-1 is switched from low (L) to high (H), elevating plate 2 starts being elevated and, when plate 2 has ascended to its normal position in which the upper surface of the transfer sheet stack is brought into pressure contact with paper feeding roller 3 (position "a" in FIG. 2), position detection switch 4 is actuated to halt further elevation of plate 2.

While plate 2 is still being elevated, photosensor 5 detects the presence of transfer papers—if the same are present on elevating plate 2—and SIG-2 is thus switched from L to H.

As a continuous copying operation progresses, the position of the upper surface of the transfer paper stack gradually descends from position "b" to position "c" (FIG. 2). When the upper surface drops to position "c", position detecting switch 4 is tripped and plate 2 is again elevated until, upon reaching normal position "d", position detecting switch 4 is actuated whereby further upward movement of plate 2 is stopped.

During plate elevation from position "c" to position "d", position detecting switch 4 is in its inoperative state due to hysteresis in its actuator and internal mechanical components.

The aforementioned operations are performed repeatedly and, when the door 6 is opened and detector 8 is deactivated at position "f", SIG-1 is switched from H to L. Paper feeding operation is accordingly stopped and elevating plate 2 descends to the bottom "g" of the tray.

Figure 3:
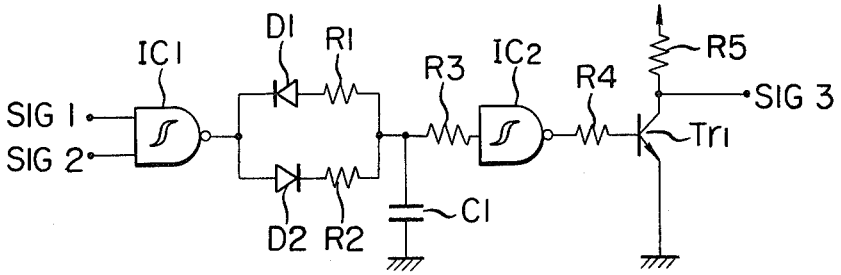
FIG. 3 is a detection and control circuit in accordance with the invention.

The detecting circuit of FIG. 3 generates an output SIG-3 that may be employed for enabling or disabling copier operation—a GO/NO GO copier operation signal. In the illustrated embodiment, a high (H) output is generated to disable copying while a low (L) output enables copying. The state of output SIG-3 is dependent upon both door opening and closing signal SIG-1 (H for door open and L for door close) and SIG-2 indicating the presence or absence of transfer paper on plate 2 as sensed by photosensor 5 (H for the presence of transfer paper and L for the absence thereof).

In the FIG. 3 circuit, IC1 and IC2 are CMOS NAND gates with Schmitt triggers for eliminating noise.

Diodes D1, D2 and resistors R1, R2 are disposed in respective series relation. The relation of $R1 >> R2$ is maintained such that, in conjunction with capacitor C1, resistor R1 regulates discharging time and resistor R2 regulates charging time.

Assume for purposes of explanation that, as an initial state, the door is open or there is no paper—in other words, that at least one of SIG-1 and SIG-2 are low (L). In that case, output SIG-3 is high (H) and copying is correspondingly disabled. During this time, capacitor C1 has been charged up to the voltage of the electric power source through resistor R2.

When the door is then closed after the addition of transfer papers to the tray, SIG-1 becomes high (H) and elevating plate 2 starts to ascend towards its normal position. As the upper surface of the transfer paper stack approaches photosensor 5, SIG-2 is switched from low to high (H) and the electric potential stored in capacitor C1 begins to discharge through resistor R1.

At this point in time, the upper surface of the transfer paper stack has not yet reached its normal operating position. Assume for the moment that the interval from the point of time at which SIG. 2 switches from L to H to the point of time when the upper surface of the sheet stack reaches its normal position is defined as T3, and further that the relation between T3 and T1 (the discharge time lag or delay determined by resistor R1 and capacitor C1) is established as $T1 > T3$. Those skilled in the art will now appreciate that SIG-3—which indicates when copying should be permitted—will switch from high to low *after* the upper surface of the transfer paper stack has reached its normal operating position.

When the transfer papers on plate 2 are exhausted or the door is opened, capacitor C1 is immediately charged through resistor R2, and SIG-3 will switch from low to high to thereby disable or inhibit copying after a period of time T2 (determined by resistor R2 and capacitor C1) has passed.

As an example, values of $T1=5$ seconds, $T2=10$ milliseconds and $T3=3$ seconds may be utilized. In this manner, copying becomes possible approximately two seconds after the upper surface of the transfer paper stack has reached its normal position and, when the supply of transfer sheets is exhausted or the door is opened, a signal disabling or inhibiting copying is provided almost at once.

As described above, the elevator type paper feeding tray of the invention is capable of constantly smooth paper feeding as a consequence of the provision of straightforward GO and NO GO copier operating signals. These signals are generated by a simple circuit through information obtained by photosensor 5 and sensed information as to the open or closed state of a door of the apparatus. Additional transfer paper can be easiliy supplied to the supporting plate because the tray is of an elevator type. Furthermore, the presence or absence of transfer paper, and the paper feeding position and the like, can be determined automatically.

What is claimed is:

1. In an elevator type paper feeding apparatus, first detecting means for generating a signal upon detecting the existence of transfer paper on a tray, second detecting means for generating a signal upon detecting that a door is closed, and a detecting circuit for generating an output signal indicating permissability of copying following the lapse of a prescribed period of time (T1) after receipt of the signals from said first and second detecting means, wherein T1 is longer than a period of time from a point of time when the presence of paper on the tray is initially detected by said first detecting means to a point of time when the paper reaches a regular feeding position.

2. In an elevator type sheet feeding apparatus which includes a sheet supporting tray movable between a lowered sheet loading position and a raised sheet feeding position, a normally closed door through which sheets may be loaded onto the tray in an open condition of the door, switch means for detecting the closed condition of the door and for generating an output signal in response to said detection, and photoelectric means for detecting the presence of sheets on the tray and for generating an output signal in accordance therewith, circuit means for receiving the output signals from said switch means and said photoelectric means and for generating a copier operating enabling output a predetermined period of time following initial coincidence of both the switch means output signals indicating the closed condition of the door and the photoelectric means output signal indicating the presence of sheets on the tray, said predetermined period of time being sufficient to enable the tray, as the same is raised from its lowered sheet loading position to its raised sheet feeding position, to move between a position at which the presence of sheets on the tray is initially detectable by said photoelectric means and a position at which sheet feeding from the tray may take place.

* * * * *